US010703611B2

(12) United States Patent
Carter et al.

(10) Patent No.: US 10,703,611 B2
(45) Date of Patent: Jul. 7, 2020

(54) SHACKLE ASSEMBLY FOR USE IN LIFTING AN OBJECT

(71) Applicant: Gearench Division of Orbix Corporation, Clifton, TX (US)

(72) Inventors: Mark Carter, Clifton, TX (US); Patrick Johnson, Clifton, TX (US)

(73) Assignee: GEARENCH DIVISION OF ORBIX CORPORATION

( * ) Notice: Subject to any disclaimer, the term of this patent is extended or adjusted under 35 U.S.C. 154(b) by 0 days.

(21) Appl. No.: 16/415,679

(22) Filed: May 17, 2019

(65) Prior Publication Data

US 2019/0352142 A1 Nov. 21, 2019

Related U.S. Application Data

(60) Provisional application No. 62/672,702, filed on May 17, 2018.

(51) Int. Cl.
*B66C 1/66* (2006.01)

(52) U.S. Cl.
CPC ..... *B66C 1/66* (2013.01)

(58) Field of Classification Search
CPC ..... B66C 1/66; B66C 1/36; F16B 45/02
USPC ..... 294/82.19
See application file for complete search history.

(56) References Cited

U.S. PATENT DOCUMENTS

| | | | | |
|---|---|---|---|---|
| 3,337,256 | A * | 8/1967 | Shropshire, Jr. | B66C 1/127 294/82.1 |
| 4,221,419 | A * | 9/1980 | Riley | B66C 1/64 294/106 |
| 4,371,203 | A * | 2/1983 | Munro | B66C 1/64 294/103.1 |
| 8,434,800 | B1 | 5/2013 | LeBlanc | |
| 8,434,801 | B2 | 5/2013 | LeBlanc | |
| 8,899,645 | B2 | 12/2014 | LeBlanc | |
| 8,960,748 | B2 | 2/2015 | Scott | |
| 8,991,883 | B1 * | 3/2015 | Butterfield, IV | B66C 1/66 294/67.3 |
| 9,493,326 | B2 * | 11/2016 | Simmons | B66C 1/66 |

FOREIGN PATENT DOCUMENTS

| | | | | |
|---|---|---|---|---|
| WO | WO-2008022368 A1 * | 2/2008 | | B66C 1/64 |
| WO | WO-2017054824 A1 * | 4/2017 | | B66C 1/36 |

* cited by examiner

*Primary Examiner* — Stephen A Vu
(74) *Attorney, Agent, or Firm* — Bracewell LLP; Constance G. Rhebergen

(57) ABSTRACT

A shackle assembly used for lifting an object includes clevis members that each mount to a pin, and are moveable about the pin and into orientations for attachment to the object. Each clevis member includes a main body with an opening that receives the pin. A set of spaced apart and parallel legs project from the main body in a direction away from the pin. Spherical bearings are set between the pin and each main body that enable each clevis member to move with multiple degrees of freedom about the pin. Fasteners project between the free ends of each set of legs, and which are for engaging the object.

16 Claims, 2 Drawing Sheets

SHACKLE ASSEMBLY FOR USE IN LIFTING AN OBJECT

CROSS-REFERENCE TO RELATED APPLICATION

This application claims priority to and the benefit of U.S. Provisional Application Ser. No. 62/672,702, filed May 17, 2018; the full disclosure of which is incorporated by reference herein in its entirety and for all purposes.

BACKGROUND OF THE INVENTION

1. Field of Invention

The present disclosure relates to a device for use when lifting an object. More specifically, the present disclosure relates to a device with linkage members that are selectively moveable into multiple orientations for engagement with attachment points on the object

2. Description of Prior Art

Connections in some piping circuits are made with flanges that are bolted together. Flanges are circular planar members with axially formed bolt holes spaced along their outer perimeters. Some flanges have open mid-sections, and which attach coaxially onto ends of tubulars, or to nozzles mounted on pressure vessels. The open mid-sections register with bores in the tubulars or nozzles. Other types of flanges are "blind" flanges, which also usually have bolt holes on their outer periphery, but are otherwise solid and without an open mid-section. Blind flanges are typically used for blocking fluid communication at the end of the tubulars or nozzles on which they are attached.

Industrial scale processing facilities often include multiple piping circuits, many of which contain piping with diameters of up to 24 inches or greater. Because flanges are commonly made up of metals such as carbon steel, flanges can often become unwieldy and weigh more than what operations personnel can safely handle. Handling the flanges usually involves one or more of lifting, moving, installing, repairing, or removing the flanges. Flanges can be handled with a lifting device that engages bolt holes in the flanges. However, placement of the bolt holes and their respective spacing from one another can vary due to flange size and also pressure ratings; and which introduces complications to forming a device suitable for handling flanges of different sizes and configurations.

SUMMARY OF THE INVENTION

Disclosed herein is an example of a shackle assembly for use in lifting an object, and which includes an elongated cylindrical pin having an axis, first and second planar clevis members coupled with the pin. Each clevis member includes a main body portion with legs that extend from an end of the main body portion and that are parallel to one another. Legs on the same main body define a set of legs. Bearing assemblies are included that are placed between the clevis members and the pin. Each bearing assembly includes an inner race having a spherically profiled outer surface and mounted onto the pin, and an outer race set in a main body portion of a one of the clevis members. An inner surface of the outer race is profiled complementary to the spherically profiled outer surface of the inner race, so that each clevis member is selectively moveable about an axis parallel with the axis of the pin, and selectively moveable about axes offset from the axis of the pin. Also included in this example of the assembly is a tang element that couples with the pin between the clevis members, and that has an end distal from the pin that is configured to be engaged by a lifting device. A fastener is provided with each set of legs that selectively attaches to an object to be lifted. The fastener can be threaded to one of the legs, and in an example is a bolt, where its threads are on the shaft next to the bolt head. In one example, a flange with bolt holes provided at different angular locations about the flange is to be lifted, and the clevis members are selectively moveable about the pin so that the fasteners are each moveable into alignment with the bolt holes at the same time. The shackle assembly of Claim 1, wherein the axes comprise a clevis member axis that extends along an elongate length of each respective clevis member. In an alternative, each clevis member axis extends along a length of the respective clevis member and bisects the width and thickness of the clevis member. An example of one of the axes is a clevis member axis that extends between opposing lateral sides of each respective clevis member, and that intersects the pin axis. In one example, the axis of the pin intersects each clevis member at a location spaced away from a mid-portion of each clevis member. A bushing is optionally included that circumscribes a portion of the pin between the bearing assemblies.

Another example of a shackle assembly for use in lifting an object is described herein and that includes a pin, clevis members that couple to the pin and are spaced apart from one another. Each clevis member of this example includes, a main body coupled with the pin, arms that project from the main body and are spaced apart, and a fastener that extends between the arms. Inserting the fastener into an attachment point on an object attaches the clevis member to the object. Further included with this example is a tang member coupled with the pin and configured for attachment to a lifting line. The clevis members are optionally pivotable with respect to the pin so that the fasteners engage attachment points on the object that are spaced apart over a range of distances. The clevis members are alternatively rotatable about the pin, or gimbal about the pin and are positioned into an orientation where the fasteners are oblique with one another. Bearing assemblies are optionally disposed between the pin and clevis members, where the bearing assemblies each have an outer race in an opening formed in a clevis member, and an inner race axially affixed to the pin. In this example the inner and outer races contact one another along spherically shaped surfaces. Lanyards for connecting each of the fasteners to the pin are optionally included. In one example, a bushing is included that circumscribes a portion of the pin between the bearing assemblies, wherein the bushing is in abutting contact with bearings that mount to the pin and are in an annular space between the pin and the clevis members. In an alternative, the fastener includes a bolt head and a shaft attached to the bold head, and where a portion of the shaft adjacent the bolt head threadingly engages to a bore formed transversely through a one of the legs.

BRIEF DESCRIPTION OF DRAWINGS

Some of the features and benefits of the present invention having been stated, others will become apparent as the description proceeds when taken in conjunction with the accompanying drawings, in which.

Figure 4:
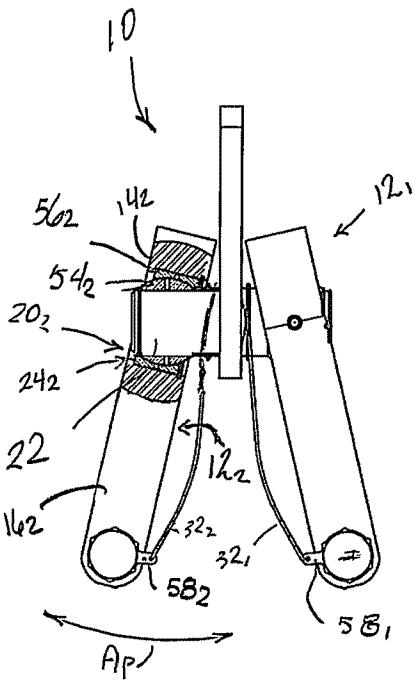
FIG. 4 is a forward partial sectional view of the shackle assembly of FIG. 1.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1:
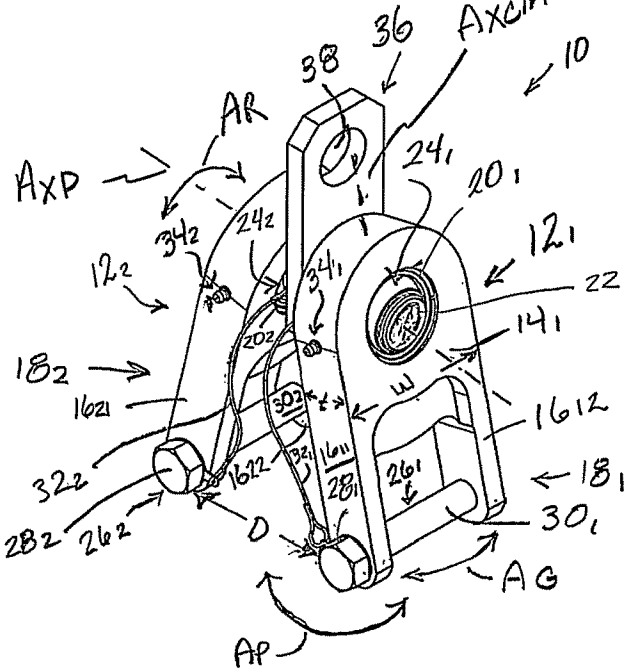
FIG. 1 is a perspective view of an example of a shackle assembly.

Shown in a perspective view in FIG. 1 is an example of a shackle assembly 10, and which includes a pair of clevis members $\mathbf{12}_{1,\ 2}$. Each clevis member $\mathbf{12}_{1,\ 2}$ is generally planar, elongated, and includes a main body $\mathbf{14}_{1,\ 2}$. Legs $\mathbf{16}_{11,\ 12}$, and legs $\mathbf{16}_{21,\ 22}$ project axially away from the main bodies $\mathbf{14}_{1,\ 2}$ respectively. Legs $\mathbf{16}_{11,\ 12}$ define a set of legs $\mathbf{18}_1$ and legs $\mathbf{16}_{21,\ 22}$ define a set of legs $\mathbf{18}_2$. In the example illustrated, main bodies $\mathbf{14}_{1,\ 2}$ have forward and rearward planar surfaces that are separated by their thicknesses t. For the purposes of discussion herein, the forward surfaces of the main bodies $\mathbf{14}_{1,\ 2}$ face one another. Lateral surfaces of the main bodies $\mathbf{14}_{1,\ 2}$ are also generally planar, and are separated by their widths W. Upper surfaces of the main bodies $\mathbf{14}_{1,\ 2}$ are generally linear between the forward and rearward surfaces, and generally curved between the lateral surfaces. Legs $\mathbf{16}_{11,\ 12}$, and legs $\mathbf{16}_{21,\ 22}$ as shown are substantially rectangular in cross section, and extend from lower surfaces of the main bodies $\mathbf{14}_{1,\ 2}$ in a direction away from the upper surfaces. Lateral surfaces of the legs $\mathbf{16}_{11,\ 12}$, and legs $\mathbf{16}_{21,\ 22}$ are coplanar with lateral surfaces of the main bodies $\mathbf{14}_{1,\ 2}$, and forward surfaces of the legs $\mathbf{16}_{11,\ 12}$, and legs $\mathbf{16}_{21,\ 22}$ are coplanar with forward surfaces of the main bodies $\mathbf{14}_{1,\ 2}$. Widths of legs $\mathbf{16}_{11,\ 12}$, and legs $\mathbf{16}_{21,\ 22}$ are along their forward and rearward surfaces, and which are exceeded in distance by their thicknesses, which like the main bodies $\mathbf{14}_{1,\ 2}$, are defined along their lateral surfaces.

Transversely formed through a mid-portion of each of the main bodies $\mathbf{14}_{1,\ 2}$ are openings $\mathbf{20}_{1,\ 2}$; one end of an annular pin 22 inserts into opening $\mathbf{20}_1$, and an opposite end of pin 22 inserts into opening $\mathbf{20}_2$. Bearing assemblies $\mathbf{24}_{1,\ 2}$ are disposed in the annular space between the pin 22 and openings $\mathbf{20}_{1,\ 2}$; and as described in more detail below allow the clevis members $\mathbf{12}_{1,\ 2}$ to move in multiple degrees of freedom about the pin 22. Ends of the legs $\mathbf{16}_{11,\ 12}$, and legs$_{21,\ 22}$ distal from their respective main bodies $\mathbf{14}_{1,\ 2}$ are transversely intersected by fasteners $\mathbf{30}_{1,\ 2}$ that mount there between. In the example of FIG. 1, each fastener $\mathbf{26}_{1,\ 2}$ includes a bolt head $\mathbf{28}_{1,\ 2}$ that attaches to an elongate and cylindrically shaped shaft $\mathbf{30}_{1,\ 2}$. Optional lanyards $\mathbf{32}_{1,\ 2}$ are illustrated, which are flexible members that provide attachment of the fasteners $\mathbf{26}_{1,\ 2}$ to the respective clevis members $\mathbf{12}_{1,\ 2}$, and serve to retain the fasteners $\mathbf{26}_{1,\ 2}$ to the clevis members $\mathbf{12}_{1,\ 2}$ during use, transportation, and/or storage of the clevis members $\mathbf{12}_{1,\ 2}$. Optional lubrication fittings $\mathbf{34}_{1,\ 2}$ are illustrated on lateral sides of each of the main bodies $\mathbf{14}_{1,\ 2}$ and through which lubrication (such as grease) is injected. In examples, the lubrication reduces friction in the bearing assemblies $\mathbf{24}_{1,\ 2}$, and optionally also prevents corrosion. A tang member 36 is further included with the example of shackle assembly 10 of FIG. 1, and which is a planar elongate element having one end attached to pin 22. An eye hole 38 is formed transversely through tang member 36 distal from its attachment to pin 22.

Figure 2:
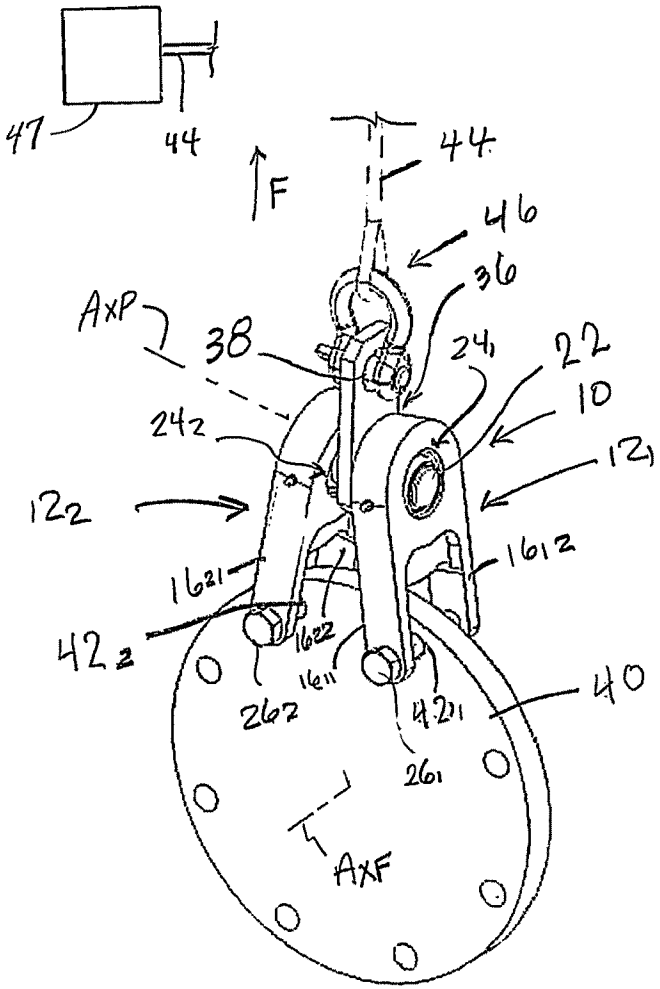
FIG. 2 is a perspective view of an example of the shackle assembly of FIG. 1 in use and lifting a flange.

Depicted in FIG. 2 is one example of using the shackle assembly 10 for handling a flange 40. Illustrated in this example are clevis members $\mathbf{12}_{1,\ 2}$ respectively engaging bolt holes $\mathbf{42}_{1,\ 2}$ transversely formed through the flange 40. More specifically, portions of the shafts $\mathbf{30}_{1,\ 2}$ between legs $\mathbf{16}_{11,\ 12}$, and legs$_{21,\ 22}$ respectively insert into bolt holes $\mathbf{42}_{1,\ 2}$. As will be described in more detail below, an advantage of the bearing assembly $\mathbf{24}_{1,\ 2}$ is that the respective clevis members $\mathbf{12}_{1,\ 2}$ are able to move or be movable into different orientations so that the fasteners $\mathbf{26}_{1,\ 2}$ register with bolt holes $\mathbf{42}_{1,\ 2}$. In this example, pin 22 is oriented with its axis $A_{XP}$ being substantially perpendicular with axis $A_{XF}$ of flange 40, where axis $A_{XF}$ intersects and is substantially perpendicular to upper and lower planar surfaces of flange 40. Further illustrated are that legs $\mathbf{16}_{11,\ 21}$, are adjacent the upper planar surface or side of flange 40; and legs$_{12,\ 22}$ are adjacent the lower planar surface or side of flange 40. In an example, objects such as flanges of different sizes or configurations may have attachment points, such as the bolt holes $\mathbf{42}_{1,\ 2}$, which are spaced apart over a wide range of different distances, or are in different or non-standard orientations. Bolt holes that are not parallel with one another, or are obliquely angled with respect to the planar surfaces of the flange, are examples of different or non-standard orientations.

Shackle assembly 10 is not limited to being used for handling a flange 40, but is useable for handling any object, and is especially useful for handling objects with non-standard attachment points. An advantage of the multiple degrees of freedom described herein is that the shackle assembly 10 can engage an object with attachment points spaced apart over a wide range of distances, and also that may be in non-standard orientations. Further illustrated in the example of FIG. 2, a line 44 is coupled to the shackle assembly 10 a hoisting clevis 46, and a force F is applied to line 44 to support flange 40, and so that flange 40 can be handled. A lifting device 47 is schematically illustrated connected to an end of line 44 distal from hoisting clevis 46, and which selectively generates and/or exerts force F onto line 44 of supporting flange 40. Another advantage realized with the shackle assembly 10 is that objects with multiple attachment points, such as the bolt holes $\mathbf{42}_{1,2}$ of the flange 40, are engaged at the same time, and the flange is handled with a single line 44

Figure 3:
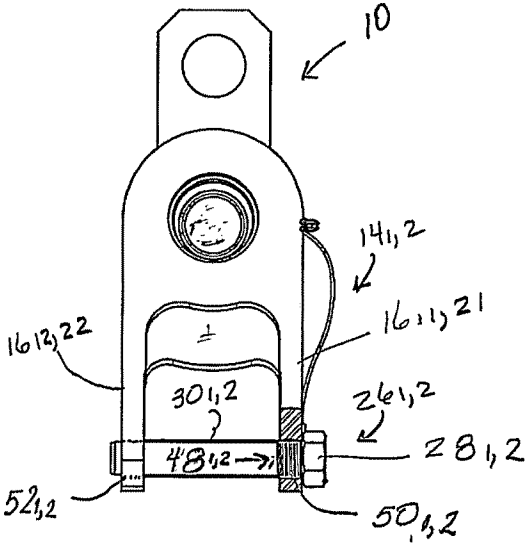
FIG. 3 is a lateral view of the shackle assembly of FIG. 1.

A side view of shackle assembly 10 is illustrated in FIG. 3, and where a portion of legs $\mathbf{16}_{11,21}$ are shown in cross section. In this example, threads $\mathbf{48}_{1,2}$ are provided on the shaft $\mathbf{30}_{1,2}$ of fastener $\mathbf{28}_{1,2}$ and adjacent the bolt head $\mathbf{28}_{1,2}$. The portion of fastener $\mathbf{26}_{1,2}$ having threads $\mathbf{48}_{1,2}$ is disposed in a bore $\mathbf{50}_{1,2}$ formed transversely through legs $\mathbf{16}_{11,21}$. In this example bore $\mathbf{50}_{1,2}$ is threaded and is threadingly engaged with fastener $\mathbf{28}_{1,2}$ via threads $\mathbf{48}_{1,2}$. The end of shaft $\mathbf{30}_{1,2}$ distal from bolt head $\mathbf{28}_{1,2}$ inserts into a bore $\mathbf{52}_{1,2}$ shown formed transversely through legs $\mathbf{16}_{12,22}$. The combination of bore $\mathbf{52}_{1,2}$ and bore $\mathbf{50}_{1,2}$ support shaft $\mathbf{30}_{1,2}$ in clevis member $\mathbf{12}_{1,2}$ when lifting or handling an object. An advantage of disposing threads $\mathbf{48}_{1,2}$ proximate bolt head $\mathbf{28}_{1,2}$ avoids the risk of threads $\mathbf{48}_{1,2}$ being damaged from contact with the portion of the object, such as flange 40 (FIG. 2) that is being engaged, such as bolt holes $\mathbf{42}_{1,2}$. Instead, the portion of shaft $\mathbf{30}_{1,2}$ that projects into opposing leg $\mathbf{16}_{12,22}$ is smooth, and its effectiveness will not be compromised even if damaged during use.

Shown in a side and partial sectional view in FIG. 4 is an example of bearing assembly $\mathbf{24}_2$ and illustrating pivoting of leg $\mathbf{16}_2$ and along an arc $A_P$. As illustrated in FIG. 4, bearing assembly $\mathbf{24}_2$ includes an inner race $\mathbf{54}_2$ shown coaxially mounted on an outer circumference of pin 22. Inner race $\mathbf{54}_2$ is a generally annular member and has a spherical outer surface. An outer race $\mathbf{56}_2$ is shown circumscribing inner race $\mathbf{54}_2$ and where outer face $\mathbf{56}_2$ is mounted within the opening $\mathbf{20}_2$ that extends transversely through the main body $\mathbf{14}_2$ of clevis member $\mathbf{12}_2$. Referring back to FIG. 1, arc $A_P$ is illustrated and which represents an example of pivotable motion of clevis member $\mathbf{12}_1$ with respect to pin 22 and due to elements in the bearing assembly $\mathbf{24}_1$ and their strategic shapes. Examples of the types of relative movement include rotation of clevis member $\mathbf{12}_1$ about pin 22 where the clevis member $\mathbf{12}_1$ rotates about axis $A_{XP}$, which as illustrated in FIG. 1 represents axis of pin 22. In this example, the clevis member $\mathbf{12}_1$ rotates about axis $A_{XP}$ and in a plane that is substantially perpendicular with axis $A_{XP}$. This motion is illustrated by the arc $A_R$. A further type of movement achievable with the shackle assembly 10 of FIG. 1 is a pivoting motion of clevis member $\mathbf{12}_1$, also about axis $A_{XP}$, but in a plane that is generally parallel with axis $A_{XP}$. Pivoting clevis member $\mathbf{12}_1$ varies a distance D between fastener $\mathbf{30}_1$ and fastener $\mathbf{30}_2$; which in one example clevis member $\mathbf{12}_1$ is pivoted so that fasteners $\mathbf{30}_{1,2}$ are in position to engage attachment points on an object. Arc $A_P$ illustrates an example of a travel path of fastener $\mathbf{30}_1$ due to pivoting clevis member $\mathbf{12}_1$. Clevis member $\mathbf{12}_1$ can also gimbal about its connection to pin 22, an example of a gimbaling motion is illustrated by arc $A_G$ where clevis member $\mathbf{12}_1$ rotates about its axis $A_{XCM}$. In an example, clevis member $\mathbf{12}_1$ is gimbaled to position fastener $\mathbf{30}_1$ into an orientation to engage an attachment point on an object. An example exists where fasteners $\mathbf{26}_{1,2}$ each engage an object, and are oblique to one another due to gimbaling of one or both clevis member $\mathbf{12}_{1,2}$.

In the example of FIG. 1, axis $A_{XCM}$ extends lengthwise through main body $\mathbf{14}_1$, intersecting upper and lower surfaces of main body $\mathbf{14}_1$, and bisecting the width and thickness of main body $\mathbf{14}_1$. It should be pointed out that examples exist where clevis member $\mathbf{12}_2$ is rotated, pivoted, or gimbaled similarly to that of clevis member $\mathbf{12}_1$ described above. Moreover, examples exist where each clevis member $\mathbf{12}_{1,2}$ is rotated, pivoted, or gimbaled at the same time; alternatively, one of the clevis members $\mathbf{12}_{1,2}$ may undergo one type of motion (i.e. rotating, pivoting, or gimbaling) that is different from the other.

Figure 4A:
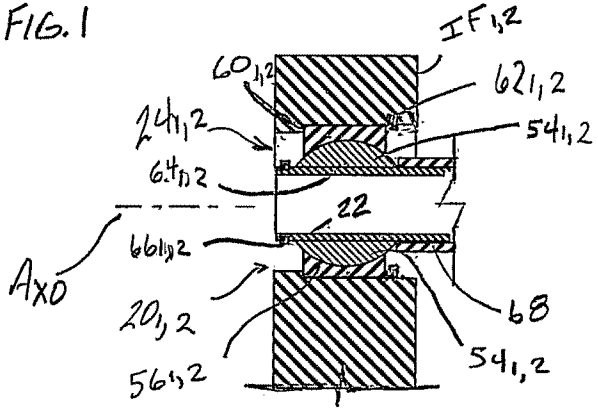
FIG. 4A is a sectional view of a portion of the shackle assembly of FIG. 1.

Referring now to FIG. 4A, shown in a side sectional view is an example of a portion of clevis members $\mathbf{12}_{1,2}$ having the bearing assemblies $\mathbf{24}_{1,2}$. As shown, opening $\mathbf{20}_{1,2}$ has a diameter that changes at a discrete location along axis $A_{XO}$ to define a shoulder $\mathbf{60}_{1,2}$ that abuts a lateral surface of outer race $\mathbf{56}_{1,2}$ proximate its outer circumference. Shoulder $\mathbf{60}_{1,2}$ provides a backstop for the bearing assembly $\mathbf{24}_{1,2}$ and prevents axial movement along axis $A_{XO}$. A retaining ring $\mathbf{62}_{1,2}$ is illustrated formed into an outer circumference of opening $\mathbf{20}_{1,2}$ on a lateral side of outer race $\mathbf{56}_{1,2}$ opposite shoulder $\mathbf{60}_{1,2}$; and which forms an opposing backstop for bearing assembly $\mathbf{24}_{1,2}$. An axial passage $\mathbf{64}_{1,2}$ is shown formed through the inner race $\mathbf{54}_{1,2}$, and in which an end of the pin 22 is inserted. A retaining ring $\mathbf{66}_{1,2}$ mounts into a groove formed on an outer surface of pin 22; retaining ring $\mathbf{66}_{1,2}$ is in abutting contact with a lateral side of inner race $\mathbf{54}_{1,2}$, and which prevents the terminal end of pin 22 from moving into axial passage $\mathbf{64}_{1,2}$. An annular bushing 68 is shown circumscribing a portion of pin 22 between opposing bearing assemblies $\mathbf{24}_{1,2}$, and which has an outer diameter greater than an inner diameter of axial passage $\mathbf{64}_{1,2}$. The combination of bushing 68 and from retaining ring $\mathbf{66}_{1,2}$ retain each bearing assembly $\mathbf{24}_{1,2}$ proximate the terminal ends of pin 22.

Figure 5A:
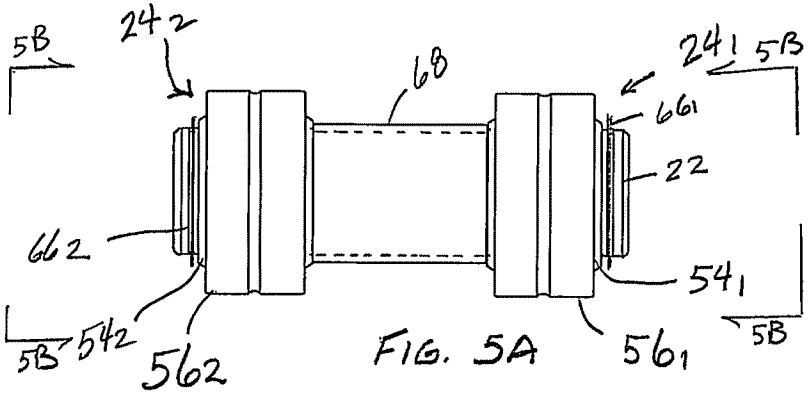
FIG. 5A is a forward view of an example of spherical bearing assemblies coupled with a pin, and for use with the shackle assembly of FIG. 1.
Figure 5B:
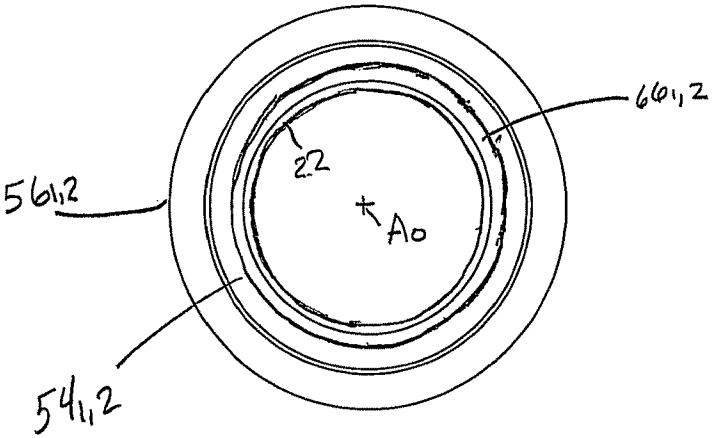
FIG. 5B is a side view of the example of FIG. 5 and taken along lines 5B-5B.

Illustrated in side and axial views respectively in FIGS. 5A and 5B is an example of the bearing assemblies $\mathbf{24}_{1,2}$ mounted on pin 22. Shown in FIG. 5A are the outer surfaces of outer races $\mathbf{56}_{1,2}$ circumscribing the pin 22. Bushing 68 is illustrated on the portion of pin 22 between the bearing assemblies $\mathbf{24}_{1,2}$ and which provides abutting contact with respective inner lateral surfaces of the inner races $\mathbf{54}_{1,2}$. Further illustrated are the retaining rings $\mathbf{66}_{1,2}$ set in grooves circumscribing the pin 22 on its distal ends. Illustrated in FIG. 5B are end views of the assembly of FIG. 5A, depicting retaining ring $\mathbf{66}_{1,2}$ circumscribing pin 22, and in interfering contact with inner race $\mathbf{54}_{1,2}$ to prevent axial movement along pin 22. Also illustrated is outer race $\mathbf{56}_{1,2}$ circumscribing inner race $\mathbf{54}_{1,2}$.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A shackle assembly for use in lifting an object comprising:

an elongated cylindrical pin having an axis;

first and second planar clevis members coupled with the pin, each clevis member comprising a main body portion and spaced apart legs that extend from an end of the main body portion and parallel to one another to define a set of legs;

bearing assemblies disposed between the clevis members and the pin, each bearing assembly comprising, an inner race having a spherically profiled outer surface and mounted onto the pin, and an outer race set in a main body portion of a one of the clevis members and having an inner surface profiled complementary to the spherically profiled outer surface of the inner race, so that each clevis member is selectively rotational about an axis parallel with the axis of the pin, and also selectively rotatable about axes not parallel to the axis of the pin;

a tang element coupled with the pin between the clevis members, and having an end distal from the pin that is configured to be engaged by a lifting device;

a fastener coupled with each set of legs and that selectively attaches to an object to be lifted.

2. The shackle assembly of claim 1, wherein the fastener is threadingly coupled with at least one leg of the set of legs.

3. The shackle assembly of claim 2, wherein the fastener comprises a bolt with a bolt head, shaft attached to the bolt head, and threads on a portion of the shaft adjacent the bolt head.

4. The shackle assembly of claim 1, wherein the object to be lifted comprises a flange having bolt holes provided at different angular locations about the flange, and wherein the clevis members are selectively moveable about the pin so that the fasteners are each moveable into alignment with the bolt holes at the same time.

5. The shackle assembly of claim 1, wherein the axes comprise a first axis and a second axis, and wherein the first axis comprises a clevis member axis that extends along an elongate length of each respective clevis member.

6. The shackle assembly of claim 5, wherein each clevis member axis is substantially centered within each respective clevis member.

7. The shackle assembly of claim 5, wherein the axis of the pin intersects each clevis member at a location spaced away from a mid-portion of each clevis member.

8. The shackle assembly of claim 1, wherein the axes comprise a clevis member axis that extends between opposing lateral sides of each respective clevis member, and that intersects the pin axis.

9. The shackle assembly of claim 1, further comprising a bushing circumscribing a portion of the pin between the bearing assemblies.

10. A shackle assembly for use in lifting an object comprising:

a pin;

clevis members that couple to the pin and spaced apart from one another, each clevis member comprising, a main body coupled with the pin, arms that project from the main body and are spaced apart, and a fastener that extends between the arms, so that when the fastener is inserted into an attachment point on an object, the clevis member is attached to the object;

bearing assemblies between the pin acid clevis members, where the bearing assemblies each comprise an outer race disposed in an opening formed in a clevis member, and an inner race axially affixed to the pin, and wherein the inner and outer races contact one another along spherically shaped surfaces; and a tang member coupled with the pin and configured for attachment to a lifting line.

11. The shackle assembly of claim 10, wherein the clevis members are pivotable with respect to the pin so that the fasteners engage attachment points on the object that are spaced apart over a range of distances.

12. The shackle assembly of claim 10, wherein the clevis members are rotatable about the pin.

13. The shackle assembly of claim 10, wherein the clevis members gimbal about the pin and are positioned into an orientation where the fasteners are oblique with one another.

14. The shackle assembly of claim 10, further comprising lanyards connecting each of the fasteners to the pin.

15. The shackle assembly of claim 10, further comprising a bushing that circumscribes a portion of the pin between the bearing assemblies, wherein the bushing is in abutting contact with bearings that mount to the pin and are in an annular space between the pin and the clevis members.

16. The shackle assembly of claim 10, wherein the fastener comprises a bolt head and a shaft attached to the bold head, and where a portion of the shaft adjacent the bolt head threadingly engages to a bore formed transversely through a one of the legs.

* * * * *